US007942199B2

(12) United States Patent
Angman

(10) Patent No.: US 7,942,199 B2
(45) Date of Patent: May 17, 2011

(54) METHOD FOR INSTALLING WELLBORE STRING DEVICES

(75) Inventor: Per G. Angman, Calgary (CA)

(73) Assignee: Tesco Corporation, Houston, TX (US)

( * ) Notice: Subject to any disclaimer, the term of this patent is extended or adjusted under 35 U.S.C. 154(b) by 220 days.

(21) Appl. No.: 12/254,459

(22) Filed: Oct. 20, 2008

(65) Prior Publication Data

US 2010/0096143 A1 Apr. 22, 2010

(51) Int. Cl.
*E21B 23/06* (2006.01)
*E21B 43/10* (2006.01)

(52) U.S. Cl. ..... 166/213; 166/206; 166/243

(58) Field of Classification Search ..... 166/206, 166/213, 243, 242.1
See application file for complete search history.

(56) References Cited

U.S. PATENT DOCUMENTS

| | | | | |
|---|---|---|---|---|
| 1,286,141 | A * | 11/1918 | Stumpf | 277/336 |
| 6,840,325 | B2 | 1/2005 | Stephenson | |
| 2006/0124304 | A1 | 6/2006 | Bloess | |
| 2007/0181298 | A1 * | 8/2007 | Sheiretov et al. | 166/212 |
| 2008/0000646 | A1 | 1/2008 | Thomson | |

FOREIGN PATENT DOCUMENTS

| | | | |
|---|---|---|---|
| CA | 2565220 | A1 * | 4/2008 |
| WO | WO 2008062177 | A1 * | 5/2008 |

* cited by examiner

*Primary Examiner* — Kenneth Thompson
(74) *Attorney, Agent, or Firm* — Bracewell & Giuliani LLP

(57) ABSTRACT

A method for securing a wellbore string device to a wellbore liner tubular employs a swelling elastomer to frictionally grip a gap between the wellbore string device and the liner tubular. The swelling elastomer is positioned between the wellbore string device and the wellbore liner tubular, then activated to cause it to swell to engage the wellbore string device with the wellbore liner tubular. The wellbore string device may be a centralizer, a wear band or a torque ring.

18 Claims, 2 Drawing Sheets

METHOD FOR INSTALLING WELLBORE STRING DEVICES

FIELD OF THE INVENTION

This invention relates to a method for installing wellbore string components.

BACKGROUND OF THE INVENTION

Within the context of petroleum drilling and well completions, wells are typically constructed by drilling the well bore and completing by installing a liner tubular string, referred to as casing or liner.

The liner tubular string is installed either by running it in after the wellbore is drilled or by using the liner tubular string as the drill string to thereby drill the liner string into position. Either way, casing installation through deviated wellbores or by drilling with casing challenges the performance requirements of the casing. Installation can place severe structural demands on casing since they must survive extended periods of time in contact with the borehole wall. Devices, such as centralizers or wear bands can be mounted onto the casing to act as bearing surfaces that preferentially accommodate contact with and space the casing from the borehole wall. However, such devices must be cost effective, since they remain downhole and are not recovered. In addition, these devices must be connected to the casing in such a way that they do not compromise the casing integrity either by their means of attachment or the wear they induce.

In some previous approaches, crimping has been used to secure such devices to the liner string. Welding and setscrews have also been used.

SUMMARY OF THE INVENTION

In accordance with a broad aspect of the present invention, there is provided a method for securing a wellbore string device to a wellbore liner tubular comprising: providing a wellbore string device and a wellbore liner tubular, positioning the wellbore string device in mounting position relative to the wellbore liner tubular and with swelling elastomer positioned between the wellbore string device and the wellbore liner tubular, the swelling elastomer being capable of swelling upon activation by an activating agent, and the swelling elastomer being activated to swell to engage the wellbore string device to the wellbore liner tubular.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1A:
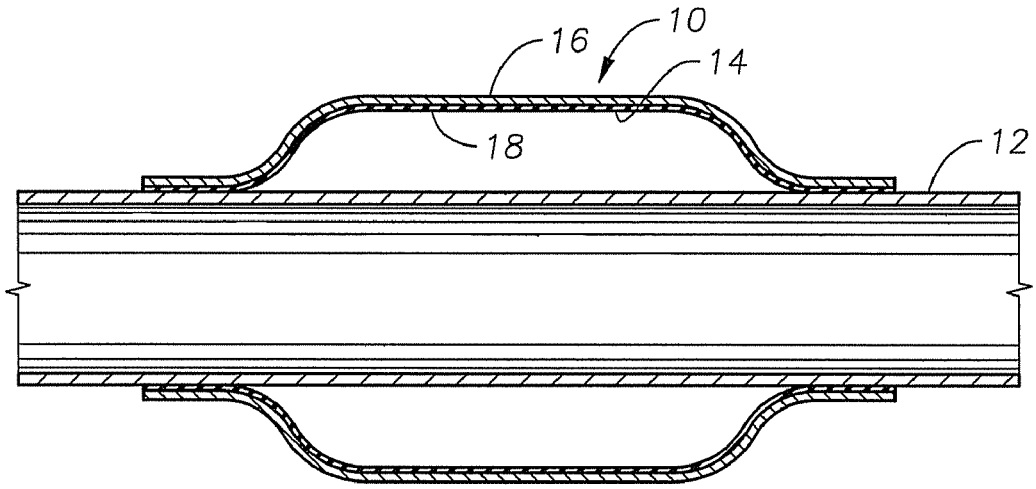
FIGS. 1*a* and 1*b* are sequential schematic vertical sections through a wellbore liner tubular with a centralizer being installed thereon.

The description that follows, and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, like parts are marked throughout the specification and the drawings with the same respective reference numerals. The drawings are not necessarily to scale and in some instances proportions may have been exaggerated in order more clearly to depict certain features.

According to the present invention, swellable elastomer may be used to install a wellbore string device to a tubular, such as a casing joint, liner joint, coupling, etc., of a, or to be used in, a wellbore string.

Various wellbore string devices may be installed using the present method including for example, a centralizer, a wear band, a torque ring or other devices to be mounted inside or on the external surface of the tubular. The wellbore string devices may be formed of various materials such as polymers and/or metal, for example steel.

The wellbore liner tubular may be a single joint or coupling or may already be connected to other tubulars for example into a string.

The swellable elastomer increases in size upon activation by an activating agent. Depending on the application, swelling elastomers may be selected to swell upon exposure to an activating agent such as water, hydrocarbons, etc. including any or all of for example, water, brine, drilling fluid, hydrocarbons, or non-hydrocarbons. The expansion and/or swelling of swellable elastomers may be by absorption of the actuating agent in the porous structure of the material or through chemical attack that modifies the chemical bonds of the material. Swelling elastomers activated by hydrocarbons and/or water include, for example, chloroprene (also known as neoprene), nitrile rubber, hydrogenated nitrile rubber, fluoroelastomers (such as for example Viton™, Kalrez™ or AFLAS™), and ethylene propylene rubber. Swelling elastomers generally swell from 5% to 200%. The properties of various swellable elastomers may be studied in the prior art so that the expansion, suitable activating agent, swelling mechanism, etc. may be predicted. Once the material has expanded, it To install the wellbore string device to a tubular, an amount of swellable elastomer is introduced into the space between the device and the tubular. Such introduction may be by applying the elastomer, prior to swelling, to the device and/or on the surface of the tubular in the location on which the device is to be installed. This application can be conducted before or after the device is moved to its mounting position relative to the tubular. The installation of the wellbore string device to the tubular by application and swelling of a swellable elastomer, is at least in part conducted at surface, before introduction to the wellbore, such that the position of the device on the tubular may be selected and maintained.

Referring to FIG. 1*a*, a centralizer 10 is shown positioned on a wellbore liner tubular, in this embodiment a joint of casing 12, and is ready to be installed thereon. Centralizer 10 has an inner surface 14, facing an axial bore therethrough, and an outer surface 16. The centralizer is installed with casing 12 extending through the centralizer inner bore and with the centralizer inner surface facing the outer surface of casing 12. In the illustrated embodiment, centralizer 10 has an inner surface with concave areas formed thereon, which correspond to the location of outwardly extending centralizing surfaces on the outer surface. Centralizer 10 is formed to centralize the casing within the wellbore and space the casing from the wellbore wall during installation of the casing. Centralizer 10 may thus be formed of durable material such as metal.

A layer of swellable elastomer 18 is coated on the inside of the centralizer. Then, before installation, the centralizer is dipped in an amount of activating agent, for example water, and then the centralizer is slid into position on the casing. Few if any installation tools are required.

Figure 1B:
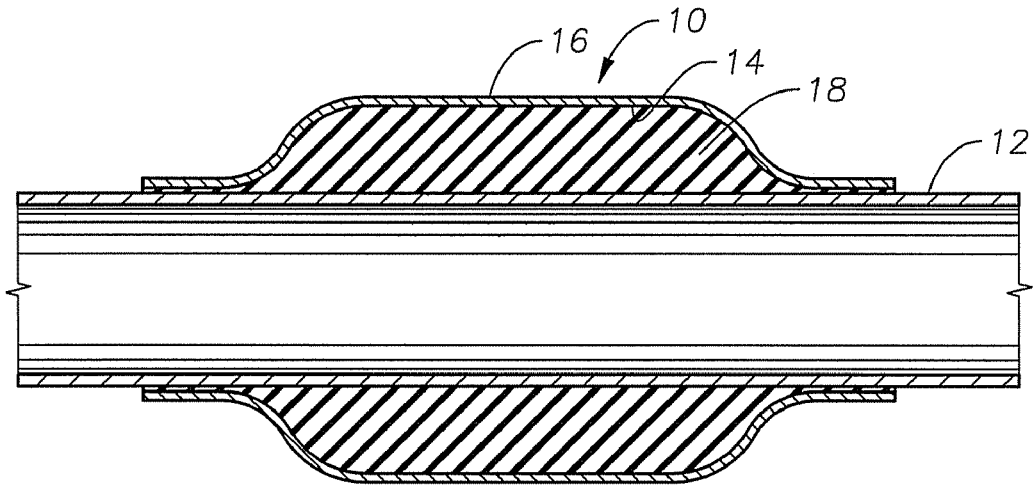

Referring to FIG. 1*b*, within a period of time, such as for example a few minutes, the swellable elastomer may begin to swell to form an expanded elastomer 18*a* between the centralizer and the casing to hold the centralizer in position. Over a following period elastomer 18*a* may continue to swell. The swelling activity and mechanism of the swellable elastomer may vary. In some elastomers, a final stage is that of setting in a substantially hardened form while others retain a substantially resilient, hardened form as they swell.

The amount of swellable elastomer used may be selected to be sufficient, when fully expanded, to fill the gap between the centralizer inner surface and the casing outer surface and to hold the centralizer in place against the forces and environment to be withstood during installation (running in or drilling in) of the casing. For example, when finally expanded, the elastomeric material assumes or retains sufficient mechanical properties (e.g. hardness, modulus of elasticity, elongation at break, tensile strength, etc.) A cost benefit may be provided by considering the properties of the elastomer and selecting an appropriate amount for the installation without considerable excess material swelling out from between the device and the tubular. With respect to coating the inner surface, the coverage need not be complete, but simply sufficient such that the gap is filled and the centralizer remains in place during use of the casing.

It may be useful to install the device to allow sufficient time for proper expansion and possibly setting of the elastomer before the casing is to be used. In one embodiment, an expanding/setting time of 24 hours or more may be required.

Figure 2:
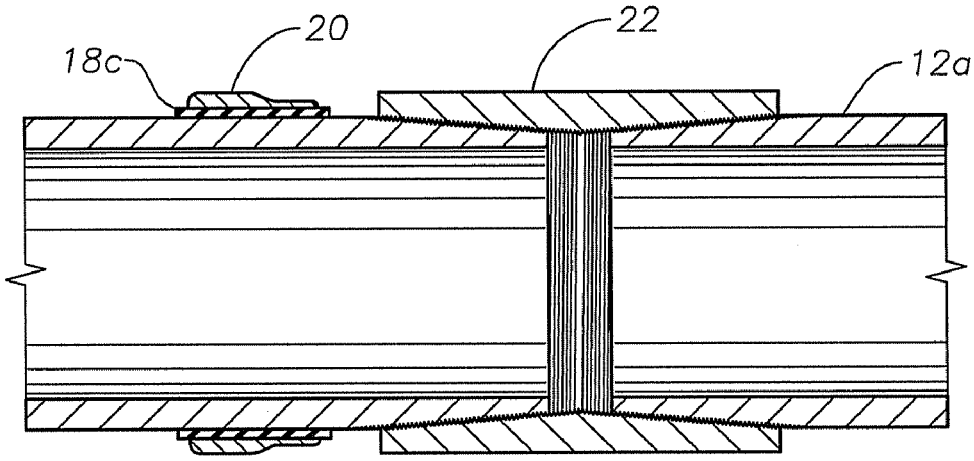
FIG. 2 is a schematic vertical section through a wellbore liner tubular with a wear band installed thereon.

Referring to FIG. 2, a casing wear band 20 has been installed on a casing joint 12*a* adjacent, and in this embodiment adjacent a downhole end of, a casing coupling 22. Casing wear band 20 is installed by an expanded swellable elastomer 18*c*, which was, prior to expansion, injected between the casing wear band and the casing and then caused to swell by contact with an activating agent, as by pouring the activating agent over the assembled parts.

Figure 3:
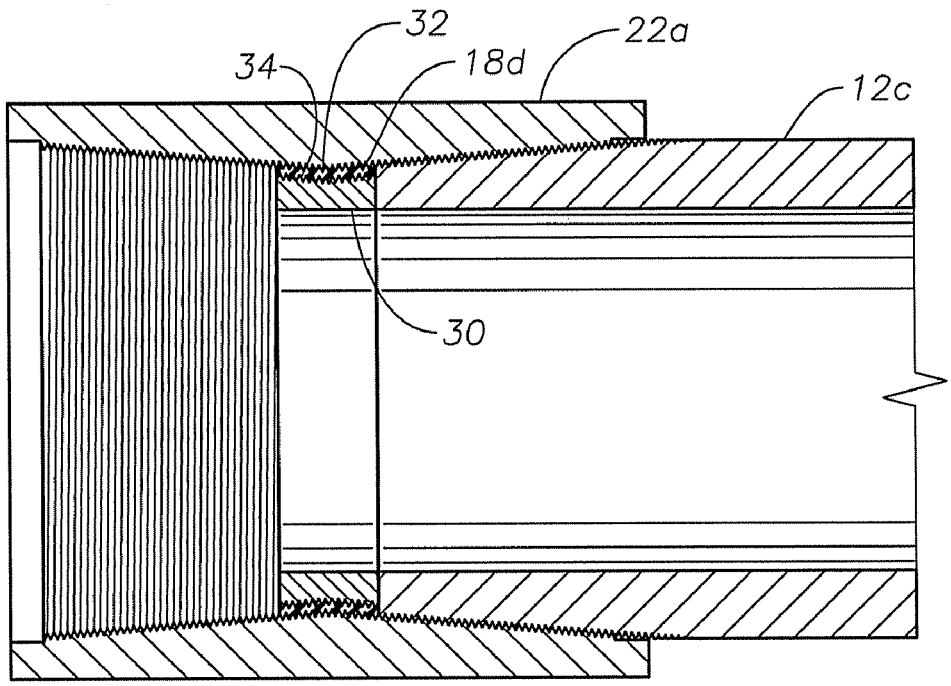
FIG. 3 is a schematic vertical section through a wellbore liner tubular connection with a torque ring installed therein.

Referring to FIG. 3, a torque ring 30 is installed at the thread crest 32 in a casing coupling 22*a*. As such, the torque ring is positioned for acting in the J-space between the pin ends of a pair of casing joints, one of which is shown at 12*c*. To install the torque ring, in one embodiment, the outer surface 34 of the ring has applied thereto an amount of swellable polymer, the ring and swellable polymer are contacted with an activating agent, such as water or a hydrocarbon, causing it to swell and before the swellable material expands to a problematic degree, the ring is installed in the coupling at the thread crest. The swellable material expands to form an expanded, material 18*d* that holds the ring in position in the casing such that the pin ends of the casing joints, for example casing joint 12*c*, may be threaded in against it. As will be appreciated, a torque ring is intended to facilitate a torqued connection by installing the torque ring between the pin ends such that the end faces of the pin ends bear thereagainst. The torque ring inner surface is intended to be generally flush with the casing inner diameters (ID).

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method for securing a wellbore string device to a wellbore liner tubular comprising:

providing a wellbore string device and a wellbore liner tubular;

positioning the wellbore string device in a mounting position relative to the wellbore liner tubular and with a swelling elastomer positioned between the wellbore string device and the wellbore liner tubular, the swelling elastomer being capable of swelling upon activation by an activating agent; and activating the swelling elastomer to cause it to swell to engage the wellbore string device with the wellbore liner tubular, thereby frictionally securing the wellbore string device to the wellbore liner tubular.

2. The method according to claim 1, wherein positioning the wellbore string device in a mounting position comprises placing the swelling elastomer and the wellbore string device on an exterior portion of the wellbore liner tubular.

3. The method according to claim 1, wherein positioning the wellbore string device in a mounting position comprises placing the swelling elastomer and the wellbore string device in an interior portion of the wellbore liner tubular.

4. The method according to claim 1, wherein positioning the wellbore string device in a mounting position comprises placing the wellbore string device in contact with the swelling elastomer prior to activating the swelling elastomer.

5. The method according to claim 1, wherein activating the swelling elastomer occurs before lowering the wellbore string device into a wellbore.

6. The method according to claim 1, wherein:

the activating agent comprises a liquid; and activating the swelling elastomer comprises immersing the swelling elastomer with the activating agent.

7. The method according to claim 1, wherein the activating agent comprises a liquid hydrocarbon.

8. The method according to claim 1, wherein the swelling elastomer is made of chloroprene, nitrile rubber, hydrogenated nitrile rubber, fluoroelastomer, or ethylene propylene rubber.

9. The method according to claim 1, wherein:

the wellbore string device comprises an annular wear band; and positioning the wellbore string device in a mounting position comprises inserting the wear band over the wellbore liner tubular, then injecting the activating agent between the wear band and the wellbore liner tubular.

10. The method according to claim 1, wherein:

the wellbore liner tubular comprises a casing with an externally threaded end and an internally threaded casing coupling secured to the threaded end;

the wellbore string device comprises a torque ring; and positioning the wellbore string device in a mounting position comprises:

coating the swelling elastomer on an outer surface of the torque ring;

contacting the swelling elastomer with the activating agent; then placing the torque ring within the casing coupling in contact with the externally threaded end of the casing.

11. The method according to claim 1, wherein:

the wellbore liner tubular comprises a section of casing having an externally threaded end connected to an internally threaded casing coupling;

the wellbore string device comprises a torque ring within the casing coupling; and the elastomer is located between an outer surface of the torque ring and an interior surface of the casing coupling.

12. A method for securing a wellbore string device to a wellbore liner tubular comprising:

providing a wellbore string device and a wellbore liner tubular;

positioning the wellbore string device in a mounting position relative to the wellbore liner tubular and with a swelling elastomer positioned between the wellbore string device and the wellbore liner tubular, the swelling elastomer being capable of swelling upon activation by an activating agent;

activating the swelling elastomer to cause it to swell to engage the wellbore string device with the wellbore liner tubular, thereby frictionally securing the wellbore string device to the wellbore liner tubular, wherein:

the wellbore string device comprises a centralizer having a concave inner surface;

positioning the wellbore string device in a mounting position comprises coating the concave inner surface with the swelling elastomer; and activating the swelling elastomer comprises contacting the swelling elastomer with the activating agent after it has been applied to the centralizer and before placing the centralizer on the wellbore liner tubular.

13. A method of securing a centralizer to a section of well casing, the centralizer having upper and lower open ends, each having an inner diameter and an intermediate portion between the ends having a larger inner diameter than the ends, the method comprising:

(a) applying a swelling elastomer coating to the inner diameter of the intermediate portion;

(b) contacting, the coating with an activating agent; then (c) sliding the centralizer over the casing, and allowing the coating to swell to fill a space between the intermediate portion and the casing, thereby frictionally securing the centralizer to the casing.

14. The method according to claim 13, wherein the activating agent comprises a liquid, and step (b) comprises dipping the centralizer into the liquid.

15. The method according to claim 13, wherein the activating agent comprises a liquid hydrocarbon.

16. A wellbore apparatus, comprising:

a wellbore liner tubular;

a wellbore string device separated from the wellbore liner tubular by a gap; and an elastomer positioned in the gap, the elastomer being swollen from an initial configuration to an enlarged configuration, filling the gap and frictionally securing the wellbore string device to the wellbore liner tubular.

17. The apparatus according to claim 16, wherein:

the wellbore string device comprises a centralizer having a concave inner surface, the centralizer being inserted over the wellbore liner tubular, the elastomer being in contact with the concave inner surface and the wellbore liner tubular.

18. The method according to claim 16, wherein:

the wellbore string device comprises an annular wear band positioned around the wellbore liner tubular, with the elastomer located between the wear band and the wellbore liner tubular.

* * * * *